US005408761A

United States Patent [19]

Gazzano

[11] Patent Number: 5,408,761

[45] Date of Patent: Apr. 25, 1995

[54] SPORT SHOE AND SUPPORT SYSTEM

[75] Inventor: Richard Gazzano, Woodside, Calif.

[73] Assignee: A. D. One Sports, Inc., Woodside, Calif.

[21] Appl. No.: 99,264

[22] Filed: Jul. 29, 1993

Related U.S. Application Data

[63] Continuation of Ser. No. 865,979, Apr. 9, 1992, abandoned.

[51] Int. Cl.[6] ..... A43B 7/14; A43B 23/08; A43B 5/00

[52] U.S. Cl. ..... 36/88; 36/92; 36/69; 36/58.6; 36/102; 36/114

[58] Field of Search ..... 36/32 R, 59 C, 58.6, 36/68, 69, 91, 92, 102, 114, 88

[56] References Cited

U.S. PATENT DOCUMENTS

| | | | |
|---|---|---|---|
| 485,459 | 11/1892 | Crocker | 36/59 C |
| 2,261,453 | 11/1941 | Reinhart et al. | 36/68 |
| 3,425,075 | 2/1969 | Murray | 36/69 |
| 3,629,962 | 12/1971 | Brock | 36/59 C |
| 3,694,940 | 10/1972 | Stohr | 36/10 |
| 4,245,408 | 1/1981 | Larsen et al. | 36/114 |
| 4,262,435 | 4/1981 | Block et al. | 36/25 R |
| 4,309,832 | 1/1982 | Hunt | 36/32 R |
| 4,393,605 | 7/1983 | Spreng | 36/32 R |
| 4,510,701 | 4/1985 | Schour et al. | 36/68 |
| 4,559,724 | 12/1985 | Norton | 36/59 C |
| 4,615,126 | 10/1986 | Matthews | 36/102 |
| 4,624,061 | 11/1986 | Wezel | 36/32 R |
| 4,638,577 | 1/1987 | Riggs | 36/32 R |
| 4,670,998 | 6/1987 | Pasternak | 36/114 |
| 4,676,010 | 6/1987 | Cheskin | 36/32 R |
| 4,736,531 | 4/1988 | Richard | 36/10 |
| 4,972,613 | 11/1990 | Loveder | 36/114 |

FOREIGN PATENT DOCUMENTS

| | | | |
|---|---|---|---|
| 0057170 | 8/1982 | European Pat. Off. | 36/115 |
| 878486 | 10/1961 | United Kingdom | 36/58.6 |
| 2162043 | 1/1986 | United Kingdom | 36/88 |

*Primary Examiner*—Jimmy G. Foster
*Assistant Examiner*—Marie Denise Patterson
*Attorney, Agent, or Firm*—Hopkins & Carley

[57] ABSTRACT

A sport shoe is disclosed which provides a highly flexible, yet supportive shoe which enhances both wearer comfort and shoe performance, and virtually eliminates shoe break-in time. The shoe includes a two piece sole system, each sole having a plurality of flex areas which provide optimum flexibility in the metatarsal and phalanges regions of the wearer's foot during walking or running activities. The shoe further includes a three-point support system about (i) an adjustable heel counter, (ii) the arch region of the wearer's foot, and (iii) the lace region of the shoe, providing balanced support about the wearer's foot.

12 Claims, 6 Drawing Sheets

SPORT SHOE AND SUPPORT SYSTEM

This application is a continuation of application Ser. No. 07/865,979, filed Apr. 9, 1992, now abandoned.

TECHNICAL FIELD

This invention relates generally to sport shoes. Specifically, the relates to an orthotic sport shoe which provides optimum flexibility and support to the wearer.

BACKGROUND OF THE INVENTION

Typically, a new pair of sport shoes are relatively stiff by virtue of the material of which the soles or shoe upper are comprise, or a combination of both. Thus, an athlete must "break in" the region of the shoe which must flex when a normal heel-to-toe step is token. During the break-in period, the new sport shoe may cause the athlete discomfort and often severe pain in day-to-day running activities. In some instances, such discomfort and pain could result in adverse secondly effects throughout the athlete's legs and body due to voluntary and/or involuntary variations in the normal optimum gate of the athlete to alleviate the discomfort.

In an attempt to overcome the shortcomings associate with breaking in recreational shoes, various configurations of relief grooves have been provided in the bottom of the sole portion of the shoe. Such relief grooves generally extend transversely from the lateral side of the shoe to the medial side of the shoe in the region which flexes while taking a step. While the prior art relief grooves provide some increased flexibility in the region of concern, the degree to which the flexibility is increased is limited by the type of material used, the geometry of the groove and the thickness of the sole. Further, the prior art grooves are not ergonomically designed, but merely positioned in the general region of flexure. Illustrative is the shoe disclosed in U.S. Pat. No. 4,914,838.

In the noted patent, a sport shoe is disclosed which employs a plurality of straight ridges both on the interior surface and the exterior surface of the sole in the region of the metatarsal joints. Between each ridge is a groove of reduced thickness relative to the base of the shoe which gives when the runner impacts the ground on the ball of his foot. The ridges do not however provide for optimum flexibility. Indeed, the shoe is designed for predetermined flexure to reduce the likelihood that the athlete will suffer hyperflexure of the great toe metatarsal joint, commonly referred to as "turf-toe".

Sport shoes, while allowing for some degree of flexibility, must also provide positive support for the athlete while running for extended periods of time and at times during rapid and sudden changes of direction, and also be of light weight construction to minimize fatigue. These requirements generally operate at cross purposes, as the lighter weight fabrics typically used in athletic shoe uppers cannot provide adequate support. Thus during motion, the wearer's foot tends to slide about in the shoe upper above the sole.

In laced shoes, the laces may be pulled tightly to locally draw the shoe about the wearer's foot to enhance support, but transverse movement of the heel and toe portions of the foot in the shoe is typically not adequately restricted. Rigid external shoe counters have been provided in athletic shoes in attempts to reduce transverse movement of the wearer's heel. Illustrative are the heel counters disclosed in U.S. Pat. Nos. 2,244,504; 2,255,877 and 4,288,929. Axial movement also occurs, particularly if the wearer's heel is not held against the rear of the upper when the laces are tightened.

Athletes in some sports have addressed this problem by using overly long shoe laces with the ends wrapped about the shoe, e.g., around the ankle or beneath the sole, to extend the localized effect of the laces to more tightly secure the shoe to the foot in the laced area. A number of patents discuss shoes with grommets, loops or extra straps to provide this effect. Illustrative are U.S. Pat. Nos. 859,382; 752,173; 2,806,300; 3,138,880; 4,245,408 and 4,510,701.

In U.S. Pat. No. 4,510,701 a laced athletic shoe is disclosed which employs a cup-form counter having eyelets defined in its forwardly extending surfaces adapted to receive the ends of the shoe laces extending from the laced portion of the shoe. The cup-form counter extends about the heel portion of the shoe upper along the rear insides of the upper and also below the wearer's heel about the sole. However, when the laces are drawn tightly, the counter cupping the wearer's heel through the upper is merely drawn toward the lace portion snugging the shoe about the bottom of the wearer's heel. The counter does not provide any significant support to the upper heel or tendon areas.

Arch support is another area of concern in athletic footwear. Various removable foot supports and insoles have been employed to enhance the arch support of a shoe. Illustrative are U.S. Pat. Nos. 3,686,779 and 2,865,097. The disclosed insoles and foot support devices of the noted patents do not, however, provide adjustable degrees of support and do not lift the arch in addition to supporting it. U.S. Pat. Nos. 4,649,939 and 4,313,433 describe straps secured to the shoe at one end under the foot which wrap around the shoe externally and are removably attached to the external face of the upper to provide support to the ankle or foot. Although the degree of support provided by each of these devices can be adjusted by wrapping the straps more tightly or loosely, the straps are not an integral part of the shoe's lacing system. Thus, the overall support of a shoe employing the noted straps would not be balanced.

In U.S. Pat. No. 4,926,569 a shoe is disclosed which employs an arch support device that operates under tension to lift the wearer's arch. The device includes a single strap of elastic material provided with means to removably attach the strap at one end to the sole in the lateral arch region and attach the strap at its other end to the upper by means of the lacing structure of the shoe such that the strap is held in tension when the foot of the wearer is in the shoe thereby supporting the arch. This system also has drawbacks. First, and most significantly, the single strap system produces an adverse twisting or rotating motion (i.e., torque) about the wearer's foot and ankle. This undesirable torsion force must be continuously countered by the athlete during each successive step and, if not adequately countered, could cause serious injury to the athlete. Second, as a result of the torque produced by the strap and lack of the heel support, the system does not provide balanced support.

It is therefore an object of the present invention to provide a highly flexible, yet supportive, sport shoe which enhances both wearer comfort and shoe performance, and virtually eliminates shoe break-in time.

It is another object of the present invention to provide a sport shoe having a sole system which provides optimum flexibility in the metatarsal and phalanges regions of the wearer's foot during walking or running activities.

It is yet another object of the present invention to provide a sport shoe with a balanced support system about the wearer's foot.

SUMMARY OF THE INVENTION

The disclosed sport shoe substantially reduces or eliminates the aforementioned disadvantages and shortcomings associated with the prior art. The sport shoe is highly flexible, yet supportive, enhancing both wearer comfort and shoe performance.

The sport shoe of the present invention generally comprises a shoe upper which is adapted to receive and confine a wearer's foot, midsole and outsole members, an adjustable heel counter, lacing means for securing the shoe to the wearer's foot and a novel three-point support system. According to the invention, the midsole member is affixed to the shoe upper and includes an arcuate metatarsal groove extending substantially transverse the longitudinal axis of the midsole on at least one of the top and bottom surfaces thereof generally coincident with the metatarsal-phalangeal joints of the wearer's foot and a phalanges groove extending transverse the longitudinal axis of the midsole on at least one of the top and bottom surfaces thereof generally coincident with the interphalangeal joints of the wearer's foot to permit optimum flexure of the metatarsal-phalangeal and interphalangeal joints. The outsole is affixed to the midsole member and includes a metatarsal gap between the rearward heel portion and forefoot portion of the outsole. The metatarsal gap is generally coincident with the metatarsal groove of the midsole member when affixed thereto. The outsole member also includes a phalanges gap which is generally coincident with the phalanges groove of the midsole member when affixed thereto. The midsole and outsole members thus provide optimum flexibility in the metatarsal and phalanges regions of the wearer's foot.

The securing means of the sport shoe includes lacing members which are affixed to the shoe upper such that the lacing engaging eyelets, which are positioned along the periphery of the lacing members, are positioned in respective planes which are generally parallel to the longitudinal axis of the shoe.

The sport shoe of the present invention additionally includes a three-point support system comprising a flexible strap which is removably attached to the upper portion of the adjustable heel counter and to each side of the sport shoe at an intermediate connecting portion proximate the arch of the wearer's foot. The support strap includes a plurality of eyelets affixed to each end of the strap proximate the lacing member eyelets, whereby when the laces of the sport shoe are drawn tightly through the lacing member eyelets and the strap eyelets, the upper portion of the heel counter is drawn against the rear and side portions of the wearer's foot providing support and stability to the wearer's heel and achilles tendon and the intermediate connecting portions are drawn against the wear's arch providing support thereto. The three-point support system thus provides a balanced support system about the wearer's foot.

BRIEF DESCRIPTION OF THE DRAWINGS

The above and other objects of the present invention will become apparent, as will a better understanding of the concepts underlying the present invention, by reference to the description which follows when taken in conjunction with the accompanying drawings in which.

DETAILED DESCRIPTION OF THE INVENTION

Figure 1:
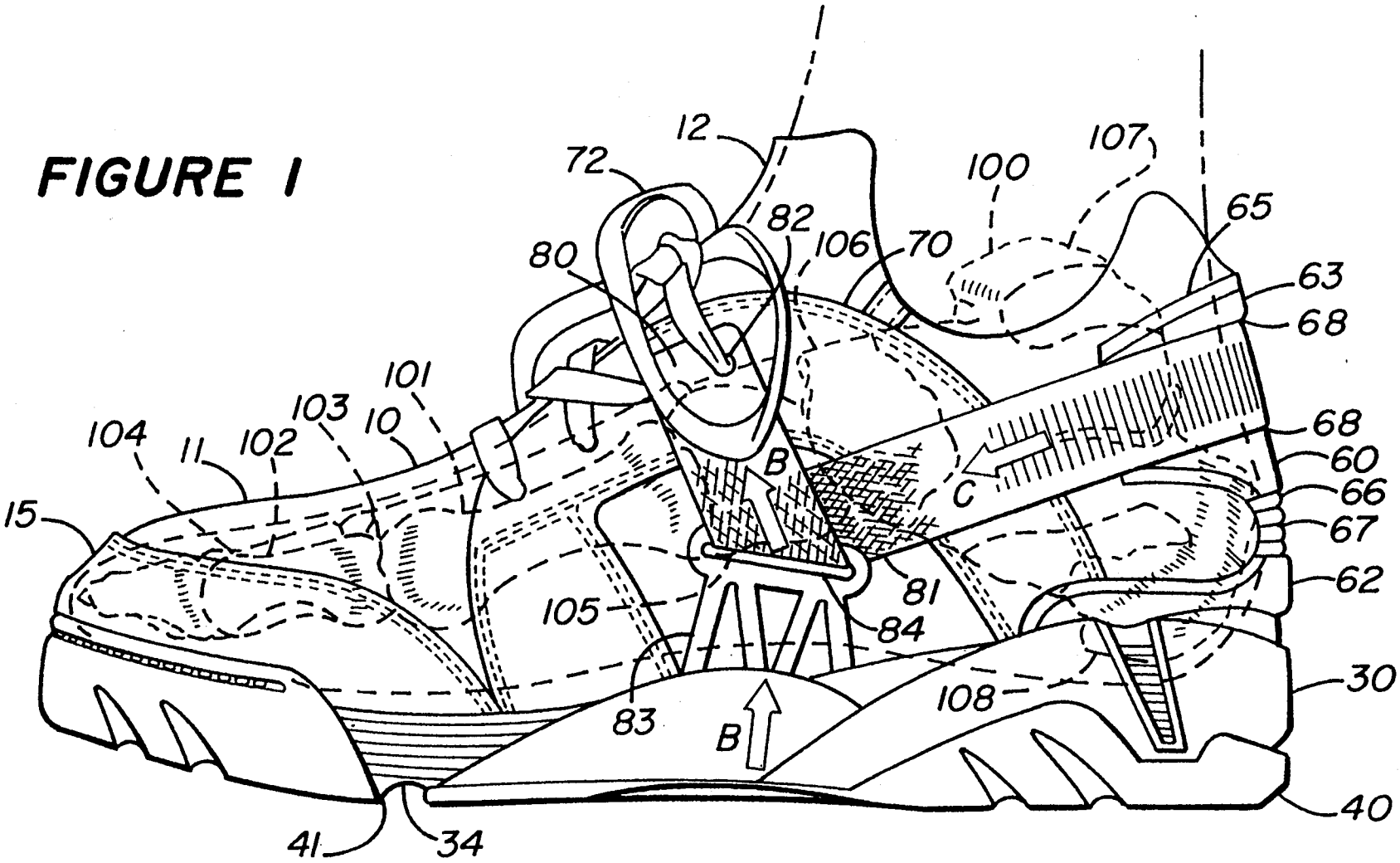
FIG. 1 is a side view of the sport shoe according to the invention.

Referring to FIG. 1, the sport shoe 1 comprises a shoe upper 10, a molded midsole member 30, a molded outsole member 40, an adjustable drawbridge heel counter 60, a novel three-point support system 80 and lacing means.

FIG. 1 includes a phantom illustration of the bone structure of the right foot 100. The metatarsal 101 and phalanges (toes) 102 bones are located on the forward portion of the foot 100. The metatarsal 101 and phalanges 102 bones are generally referred to as the first, second, third, fourth and fifth metatarsal 101 or phalanges 102 bones, respectively, moving from the medial (inside) side to the lateral (outside) side of the foot 100. Between the respective metatarsal 101 and phalanges 102 bones are joints, commonly referred to as metatarsal-phalangeal joints 103. In addition, the phalanges 102 include a plurality of interphalangeal joints 104.

The heel of the foot 100 is formed with the calcaneus bone 108 which is the largest of the tarsal bones. The calcaneus bone 108 articulates with the talus 107 and the navicular 106. The navicular 106 articulates with the cuneiform bones 105, which articulate with the base or distal end of the metatarsal bones 101.

Figure 2:
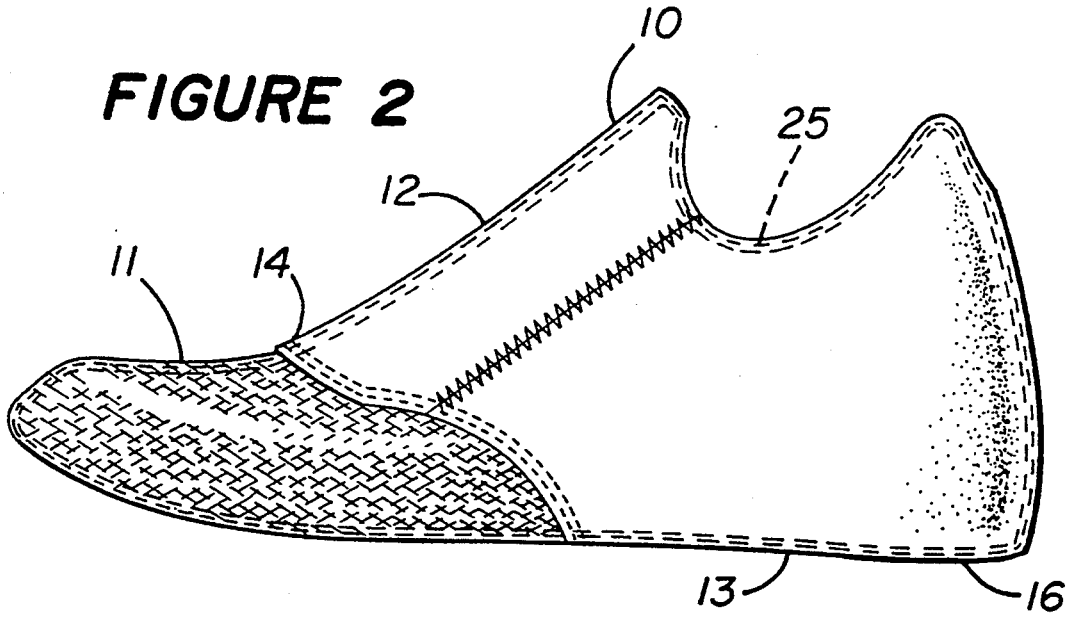
FIG. 2 is a side view of the sport shoe upper according to the invention.

In the preferred embodiment, illustrated in FIG. 2, the shoe upper 10 is adapted to receive a wearer's foot 2 and primarily comprises a toe portion 11, a vamp portion 12 and a rear portion 13. Each portion 11,12,13 is integrally connected by conventional stitching means. However, key to the assembled (i.e., interconnected) structure of the shoe upper 10 is that the line 14 defining the mating edges of the toe portion 11 and the vamp portion 12 is generally arcuate and coincident with the metatarsal phalangeal joints of the wearer's foot to enhance flexibility of the shoe upper 10.

As will be recognized by one skilled in the art, the shoe upper 10 may be constructed of various conventional light-weight material, such as nylon, canvas, leather or LYCRA®. In the preferred embodiment, the shoe upper 10 is constructed out of conventional LYCRA ® material. Although a plurality of different materials are suitable for use in connection with the shoe upper 10 and other components of the present invention, it is primarily the structure and interrelationship of the interconnected components which imparts the foregoing advantages and benefits to a sport shoe.

As illustrated in FIG. 1, a toe cap 15 is also provided to alleviate the problem of accelerated wear and tear on the toe portion 11 of the shoe upper 10. The cap 15 may be made of a conventional wear resistant material, such as leather or vinyl.

Figure 5A:
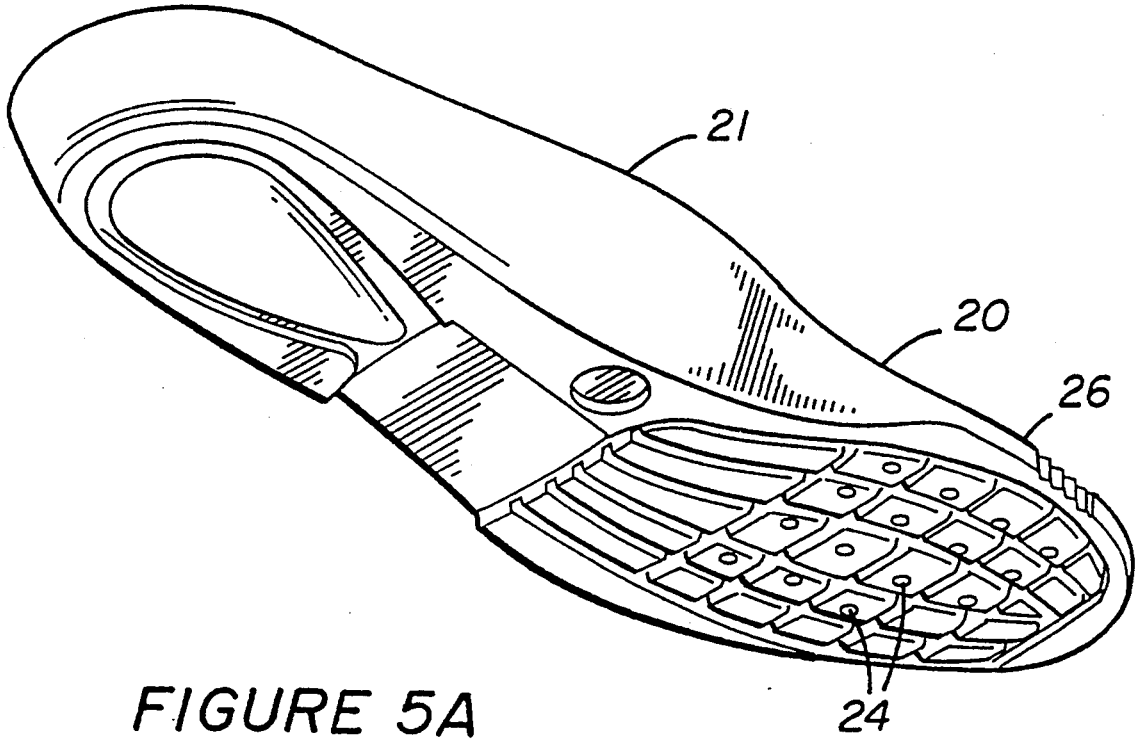
FIG. 5A and 5B are perspective views of a conventional sport shoe insole.
Figure 5B:
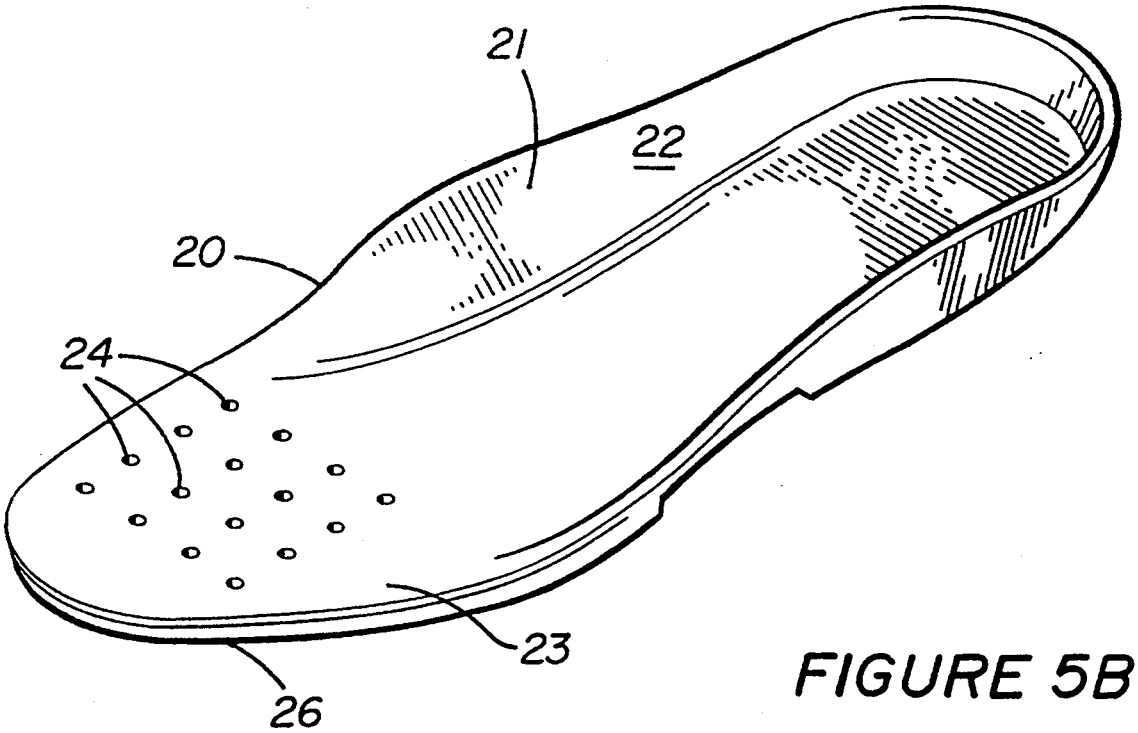

The shoe upper 10 of the present invention also includes a conventional flexible insole 20 (see FIGS. 5A and 5B). The insole 20 includes an Orthotic arch support 21 positioned proximate the lateral arch region of the wearer's foot. Generally, the arch support 21 is integrally molded into the insole 20.

The insole 20 is typically constructed out of a flexible polymeric material (e.g., polystyrene) or flexible thermoplastic rubber. A layer of foam synthetic resin 23, such as foam polyethylene, is conventionally fused to the interior surface 22 of the insole 20 to enhance the wearer's comfort. The insole 20 may further be provided with a plurality of perforations 24, disposed in the forefoot portion 26 of the insole 20, to enhance ventilation.

The shoe upper 10 further includes a one-piece insole sock lining 25, which has a configuration substantially similar to the interior surface of the shoe upper 10. By employing the insole sock lining 25, the interior of the shoe upper 10 is substantially smooth, eliminating pressure points and allowing for maximum flexibility and comfort.

The insole sock lining 25 may be constructed out of various conventional materials, preferably a foam synthetic resin such as foam polyurethane. The insole sock lining 25 may also be fused to or adhesively secured to the shoe upper 10 by conventional means.

A key feature of the present invention is the novel design and interrelationship of the midsole 30 and outsole 40 members, which provide optimum flexure of the wearer's metatarsal-phalangeal and interphalangeal joints. The sole members 30,40 thus enhance both wearer comfort and shoe performance while virtually eliminating "break-in" time.

Figure 6A:
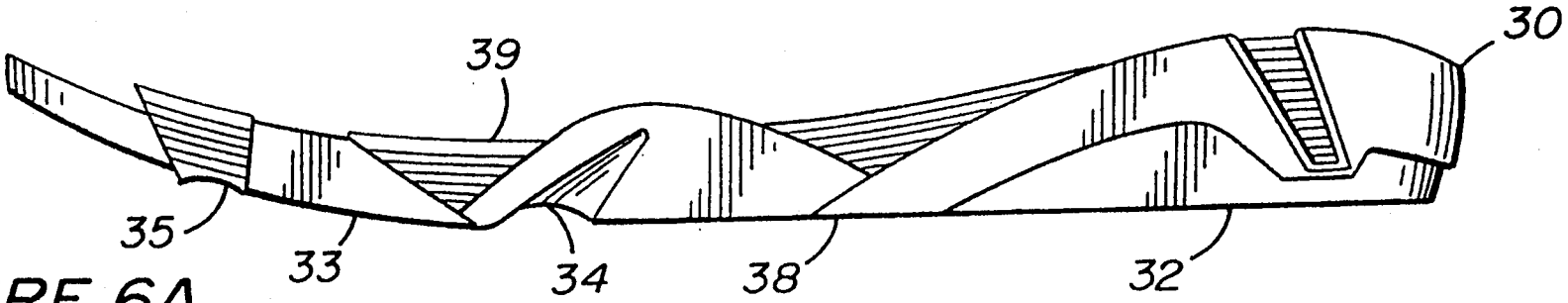
FIG. 6A is a side view of the sport shoe midsole member according to the invention.
Figure 6B:
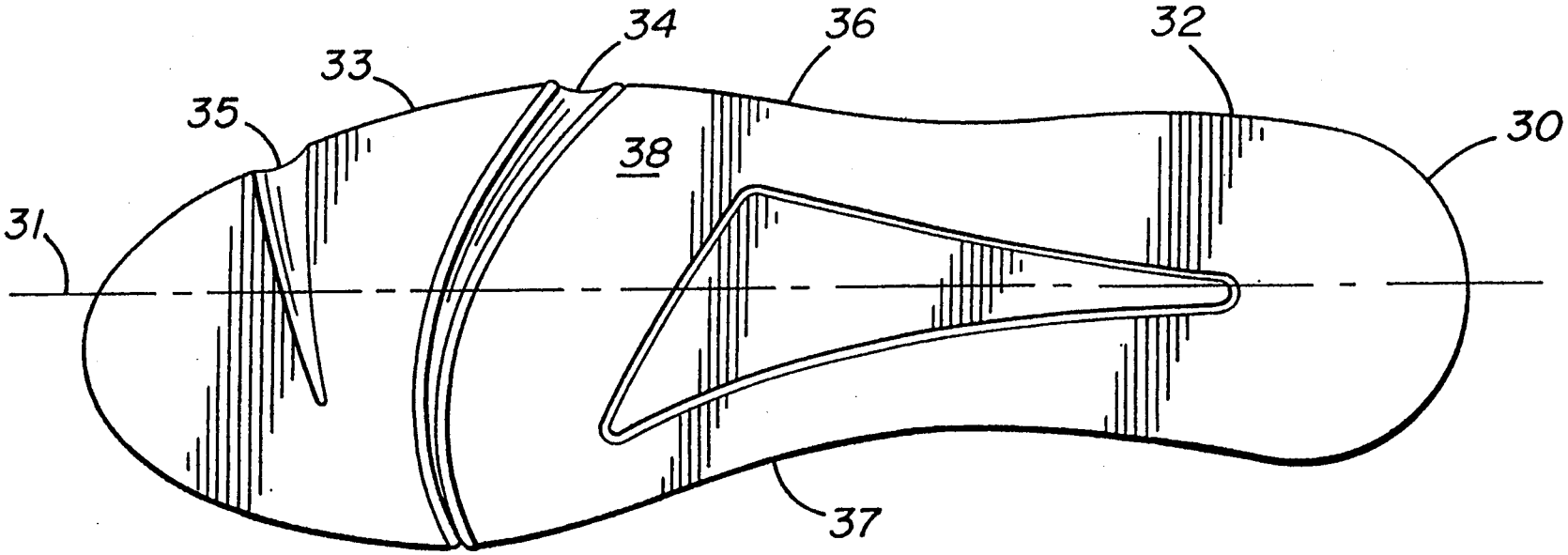
FIG. 6B is a bottom plan view of the sport shoe midsole member according to the invention.

As illustrated in FIGS. 6A and 6B the midsole member 30 of the present invention has a longitudinal axis 31, a rearward heel portion 32 and a forefoot portion 33 underlying the ball of the wearer's foot and toes. In the preferred embodiment, the midsole member 30, is integrally connected to the shoe upper 10 by conventional means.

The midsole member 30 includes a metatarsal groove 34 extending substantially transverse the longitudinal axis 31 of the midsole 30 and generally coincident with the metatarsal-phalangeal joints of the wearer's foot. The metatarsal groove 34 is generally of reduced thickness relative to the midsole 30 which therefore gives during normal heel-to-toe translation (i.e., walking, running, etc.). The metatarsal groove 34 may be positioned on the inner (i.e., top) surface 39 or the outer (i.e., bottom) surface 38 of the midsole member 30, preferably the outer surface 38 as illustrated in FIG. 6A. As will be recognized by one skilled in the art, various groove designs may be employed within the scope of this invention. However, it has been found that a parabolic groove is preferable since such a configuration closely mirrors the natural flexure of the metatarsal-phalangeal joints. Preferably, the parabolic metatarsal groove 34 has a semi-circular cross-section which varies (i.e., reduces) in thickness from the lateral side of the shoe 36 proximate the fifth metatarsal-phalangeal joint of the wearer's foot to the medial side 37 of the shoe proximate the base of the first metatarsal bone (i.e., first metatarsal-phalangeal joint) of the wearer's foot. In another embodiment of the invention, not shown, a second metatarsal groove may be employed.

The midsole member 30 also includes a phalanges groove 35 extending transverse the longitudinal axis 31 of the midsole 30 and generally coincident with the interphalangeal joints of the wearer's foot. The phalanges groove 35 may similarly be positioned on the inner surface 39 or outer surface 38 of the midsole member 30, preferably the outer surface 38 as illustrated in FIG. 6A. The phalanges groove 35 is generally of reduced thickness relative to the sole 30 which gives during normal heel-to-toe transition. The phalanges groove also has a semi-circular cross-section which varies (i.e., reduces) in thickness from the lateral side of the shoe 36 proximate the fifth interphalanges joint of the wearer's foot to the medial side 37 of the shoe. In the preferred embodiment, the phalanges groove 35 generally extends 50–80% across the bottom surface 38 of the midsole member 30 for optimum performance and comfort. In a further embodiment of the invention, not shown, second phalanges groove may be employed.

Figure 7A:
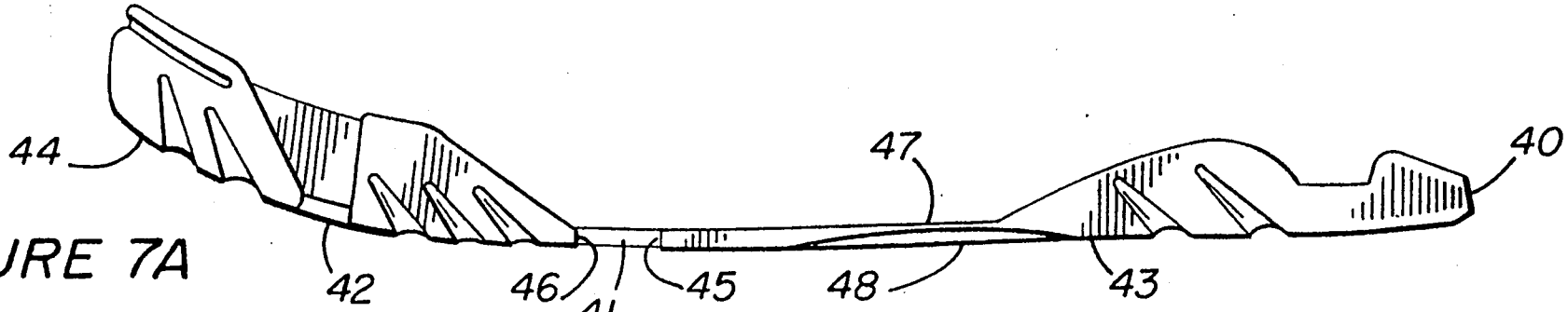
FIG. 7A is a side view of the sport shoe outsole member according to the invention.
Figure 7B:
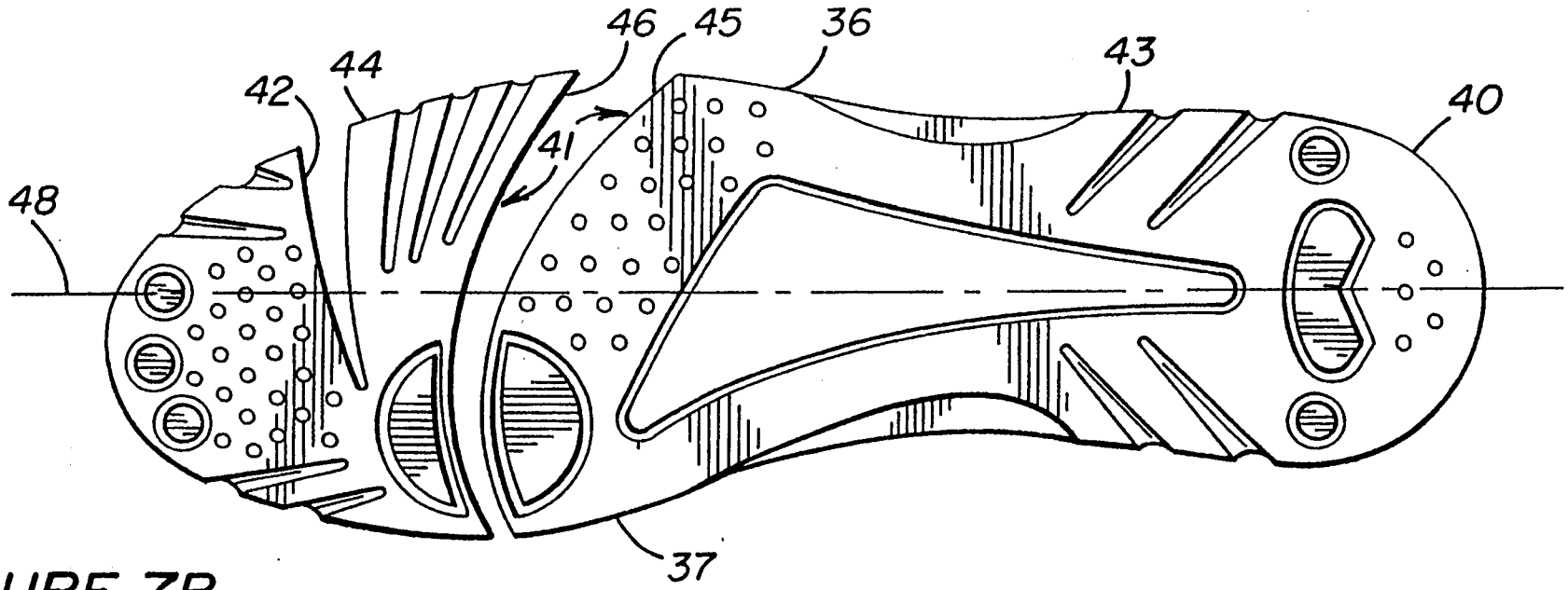
FIG. 7B is a bottom plan view of the sport shoe outsole member according to the invention.

In accordance with the present invention, an outsole member 40 is also provided which generally mirrors the midsole member 30. Referring to FIGS. 7A and 7B, the outsole member 40 has a top 47 and bottom 48 surface and is adapted to be integrally connected to the bottom 38 of the midsole member 30.

As illustrated in FIG. 7A, the outsole member 40 includes rearward heel portion 43, a forefoot portion 44 and a metatarsal gap 41 therebetween, the metatarsal gap 41 being generally coincident with the metatarsal-phalangeal of the wearer's foot. In the preferred embodiment, the metatarsal gap 41 extends through the outsole member 40 whereby the rearward heel portion 43 and the forefoot portion 44 of the outsole member 40 are separate and distinct. The contiguous sections 45, 46 of the heel portion 43 and forefoot portion 44 are generally arcuate, preferably parabolic, and the metatarsal gap 41 therebetween coincident with the metatarsal groove 34 of the midsole member 30 when affixed thereto to enhance flexibility.

In a further embodiment of the invention, not shown, the metatarsal gap 41 would partially extend through the outsole member 40 on at least the top surface 47 or bottom surface 48 of the outsole member 40, preferably the bottom surface 48 thereof. The metatarsal gap 41 would be generally arcuate, preferably parabolic, and would extend transversely from the lateral side 36 of the shoe 1 proximate the metatarsal-phalangeal joints of the wearer's foot to the medial side 37 of the shoe 1. The outsole metatarsal gap 41 would also have a semi-circular cross-section which varies (i.e., reduces) in thickness from the lateral side 36 to the medial side 37. In another embodiment, not shown, a second metatarsal gap may be employed.

The outsole member 40 also includes a phalanges gap 42 on the outsole member 40 which is generally coincident with the interphalangeal joints of the wearer's foot. In the preferred embodiment, the phalanges gap 42 extends through the outsole member 40 as illustrated in FIG. 7B. The phalanges gap 42 generally extends 50–80% across the outsole member 40 transverse the longitudinal axis 48 thereof and is generally coincident with the phalanges groove 35 on the midsole member 30 when the outsole member 40 is affixed to the midsole member 30.

In a further embodiment of the invention, not shown, the phalanges gap 41 would partially extend through the outsole member 40 on at least the top 47 or bottom 48 surface of the outsole member 40, preferably the bottom surface 48 thereof. The phalanges gap 42 would extend transversely from the lateral side 36 of the shoe 1 proximate the interphalangeal joints of the wearer's foot to the medial side 37 or the shoe 1. The phalanges gap 42 would also have a semi-circular cross-section which varies (i.e., reduces) in thickness from the lateral side 36 of the shoe proximate the fifth interphalangeal joint of the wearer's foot to the medial side 37 of the shoe 1 to enhance flexibility. In another embodiment, not shown, a second phalanges gap may be employed.

Figure 8:
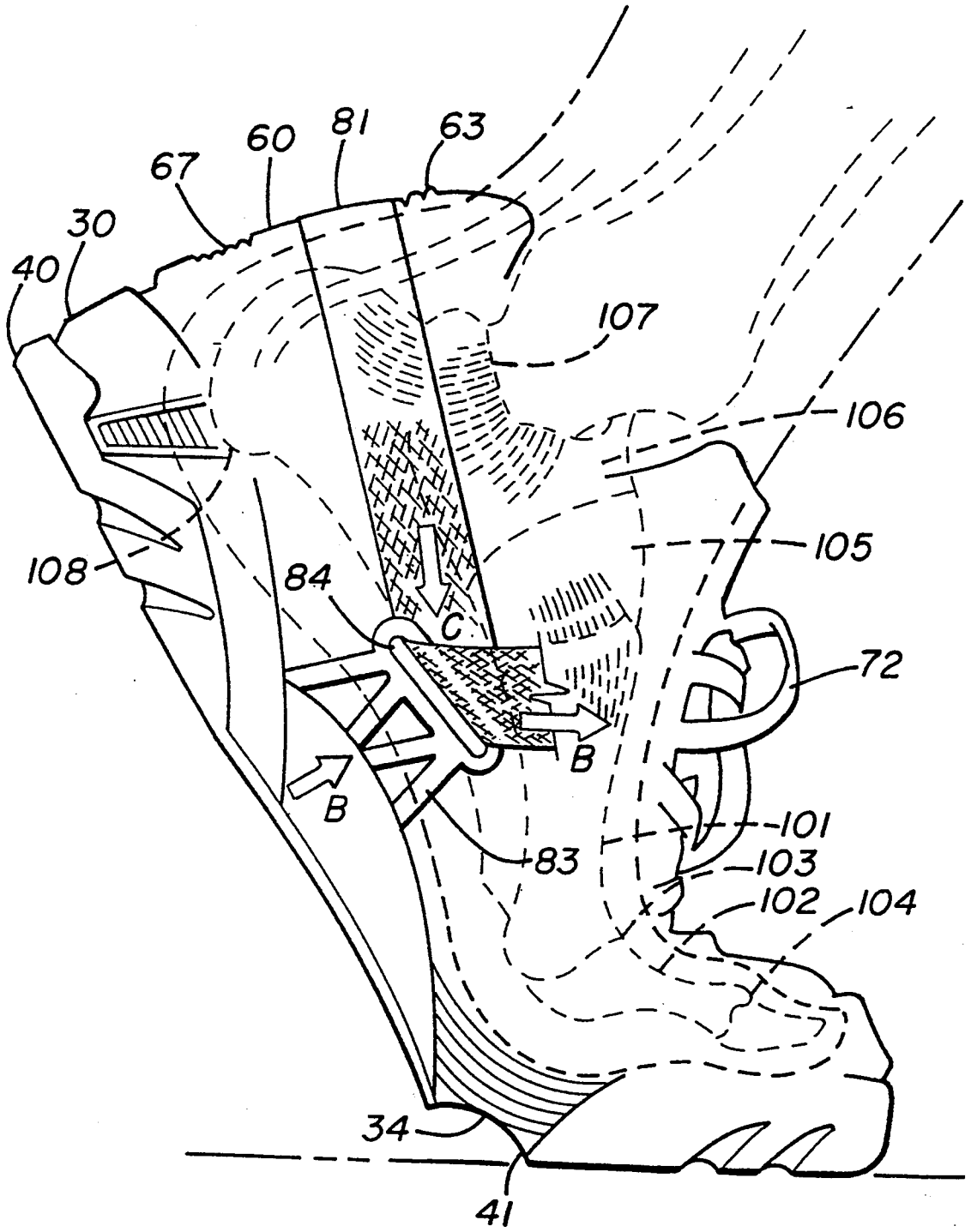
FIG. 8 is a representation of the support relationship of the heel counter and arch support to the wearer's foot according to the invention.

Thus, according to the invention, as an athlete impacts the ground on their heel and extends their leg rearward, transferring the forces from the heel to the toe, the forefoot portion 33 of the midsole member 30 will give in the region of the metatarsal and phalanges grooves 34,35, enhancing the flexibility of both the metatarsal-phalangeal and interphalangeal joints on the athlete's foot (see FIG. 8). Thus, the wearer's comfort is increased and break-in time normally associated with new sport shoes is virtually eliminated.

The midsole 30 and outsole 40 members of the present invention may be made of any material that provides suitable cushioning and traction for the wearer and, of course, has proper wear characteristics. As will be recognized by one skilled in the art, various materials may be employed.

Figure 3:
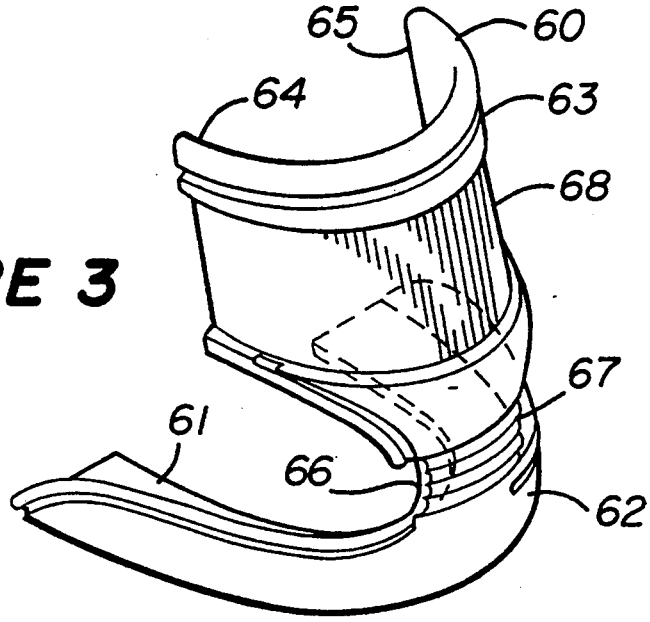
FIG. 3 is a perspective view of the sport shoe adjustable drawbridge heel counter according to the invention.
Figure 4:
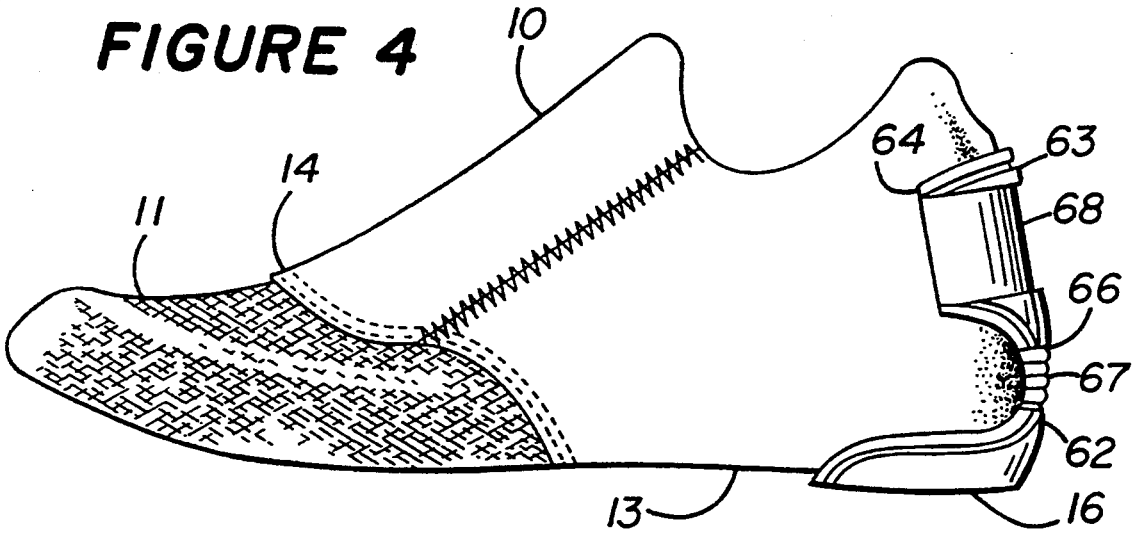
FIG. 4 is a side view of the sport shoe upper illustrating the placement of the adjustable drawbridge heel counter, according to the invention.

Extending about the shoe upper 10, proximate the heel region 16 of the rear portion 13, is an adjustable drawbridge heel counter 60, typically constructed out of molded flexible thermoplastic or similar materials (see FIGS. 2–4). As illustrated in FIG. 3, the heel counter 60 has a base portion 61, a lower portion 62, and an upper portion 63 with forwardly extending side portions 64, 65. The base portion 62 is designed and configured to extend beneath the heel portion 16 of the shoe upper 10 (see FIG. 4), above midsole member 30 when affixed thereto, to form a cup about the calcaneus bone 108 or angle juncture of the rear and bottom surfaces of the wearer's foot. In the preferred embodiment, the heel counter 60 has a generally narrower cross-sectional area 66 between the upper 63 and lower 62 portions. Corrugations 67 are employed in this narrower area 66 to accommodate the flexibility and adjustability of the heel counter 60. The corrugations 67 generally facilitate approximately 2–3 cm of adjustment. As will be recognized by one skilled in the art, various design configurations, such as corrugations 67, may be employed in this narrower area to accommodate the flexibility and adjustability of the heel counter 60. The heel counter 60 further includes a support strap guide 68 in the upper portion 63 to engage the support strap 81, as further discussed below.

Referring to FIG. 1, lacing means are also provided for securing the shoe 1 to the wearer's foot 2. The lacing means comprise a pair of lacing members 70 affixed to opposite sides of the shoe upper 10. The lacing members 70 may be constructed out of conventional vinyl or leather materials. The lacing members 70 include a plurality of lace engaging eyelets 71 along the periphery of the lacing members 70 whereby when the laces 72 of the shoe are drawn tightly through the eyelets 71 the shoe 1 is secured to the wearer's foot 2. The lacing members 70 are affixed to the shoe upper 10 such that the lace engaging eyelets 71 are positioned in respective planes which are generally parallel to the longitudinal axis of the shoe 1 and generally coincident with the first and third metatarsal bones of the wearer's foot 2 when secured within the shoe 1.

Another key feature of the invention is the novel three-point support system illustrated in FIG. 1. The support system 80 comprises a support strap 81 which is removably attached to the upper portion 63 of the drawbridge heel counter 60, intermediate each end thereof, and to each side of the shoe 1 at an intermediate connecting portion proximate the arch region of the wearer's foot. In the preferred embodiment, a pair of arch support members 83 are provided which are integrally connected to the midsole members 30, the inside (i.e., medial side 37) member 83 being positioned proximate the arch support 21 of the insole 20.

The support strap 81 may be constructed out of various flexible materials, preferably nylon, and includes a plurality of eyelets 82 disposed on each end of the strap 81. The eyelets 82 may be reinforced by conventional means. The eyelets 82 are positioned proximate eyelets 71 when the strap 81 is employed according to the invention, whereby when the laces 72 are drawn tightly through eyelets 71 and strap eyelets 82, the upper 63 and forwardly extending side portions 64,65 of the heel counter 60 are drawn against the rear and side portions of the wearer's foot 2 providing support and stability to the wearer's heel and achilles tendon, and the support members 83 are drawn against the wearer's arch providing support thereto.

The balanced support system is further described and illustrated in FIG. 8. Referring back to FIGS. 1 and 2, the wearer inserts their foot 2 into the shoe upper 10. The laces 72 are drawn tightly through peripheral eyelets 71 to exert a closing force about the wearer's foot 2.

The laces 72 are threaded through the support strap eyelets 82 and pulled tightly. The rounded, reinforced eyelets 82 facilitate lace 72 tightening as the drawing force B exerted on the lace ends is transmitted to the upper laced portion. As the reinforced eyelets 71 are integrally formed on the strap 81 ends all desired force may be applied, typically up to the breaking point of the lace 72. When sufficiently tight, the lace ends are tied proximate the angled juncture of the front surface of the wearer's leg and the top surface of the foot.

Referring to FIG. 8, the force B exerted by the shoelace 72 ends in eyelets 82 draws the support members 83 upward, urging the arch support 21 of the insole 20 against the wearer's arch providing support thereto. Force B is also transmitted through the support members 83 by virtue of the integral support member guides 84 disposed on the end of each support member 83, producing force C about the upper portion 63 of the adjustable drawbridge heel counter 60.

Force C is transmitted through the body of the heel counter 60, drawing the upper 63 and forwardly extending side portions 64,65 against the rear and side portions of the wearer's foot.

Accordingly, both transverse and axial movement of the wearer's heel is effectively restricted. The narrowed midsection 66 of the heel counter 60, in conjunction with the corrugated design 67, also provides for the desired degree of counter 60 adjustability.

From the foregoing description, one of ordinary skill in the art can easily ascertain that the present invention provides a highly flexible, yet supportive, sport shoe which enhances both wearer comfort and shoe performance, and virtually eliminates shoe "break-in" time.

Without departing from the spirit and scope of this invention, one of ordinary skill can make various changes and modifications to the invention to adapt it to various usages and conditions. As such, these changes and modifications are properly, equitably, and intended to be, within the full range of equivalents of the following claims.

What is claimed is:

1. A sport shoe comprising:

a shoe upper for containing the wearer's foot, said shoe upper including first lacing members extending across at least a portion of said shoe upper over the instep of the wearer's foot;

said first lacing members being positioned in respective planes which are generally parallel to the longitudinal axis of the sport shoe and generally coincident with the first and third metatarsal bones of the wearer's foot when secured in the shoe;

a midsole attached to said shoe upper and having a top and bottom surface, a rearward heel portion and a forefoot portion underlying the ball of the wearer's foot and the metatarsal-phalangeal and interphalangeal joints thereof;

said midsole having a generally arcuate metatarsal groove of substantially arcuate cross-section in the bottom surface thereof extending substantially across the entire width of said midsole and being positioned proximate the proximal heads of the phalanges bones of the wearer's foot;

said midsole including a generally arcuate phalanges groove of substantially arcuate cross-section in the bottom surface thereof extending from the lateral side of said midsole across at least about fifty percent of the width of said midsole and being positioned to underlie the interphalangeal joints of the wearer's foot;

an outsole secured to said bottom surface of said midsole having a top and bottom surface, a rearward heel portion, and a forefoot portion;

said outsole including a generally arcuate metatarsal gap and a generally arcuate phalanges gap substantially aligned with said phalangeal and metatarsal grooves of said midsole, respectively, whereby flexibility of said shoe is enhanced at both the metatarsal-phalangeal and interphalangeal joints of the wearer's foot;

a heel counter secured to said shoe upper, said heel counter including a lower portion and an upper portion, said upper portion being positioned to extend over the lower portion of the Achilles tendon of the wearer's foot;

a one piece insole sock lining disposed in said shoe upper and having a configuration substantially similar to the interior surface of said shoe upper to substantially envelop the wearer's foot when disposed therein; and a strap support system, said strap support system including a pair of elongated arch support members, each connected to said midsole on opposite sides of said shoe upper proximate the lesser tarsus region of the wearer's foot and extending up the sides of the shoe upper, each of said arch support members having a slot therein, said slot being disposed proximate the navicular bone of the wearer's foot;

flexible support strap means engaging said upper portion of said heel counter proximate the calcaneus bone of the wearer's foot and having a pair of free ends, said support strap means passing from said heel counter on opposite sides of said shoe upper, slideably through said slots on said arch members, and thence upwardly on opposite sides of said shoe upper proximate the middle region of the metatarsal bones of the wearer's foot;

means for limiting movement of said flexible strap means proximate the calcaneus bone to limit variations of the angle formed between said strap means and said outsole;

said arch support members and said flexible strap means being positioned to distribute forces substantially perpendicular to the axis of motion of the subtalar and midtarsal joints to maintain balance and stability of the foot in stance and during gait with the forces provided by said arch support members directed generally perpendicular to the longitudinal midtarsal joint axis, the forces provided by said support strap directed generally perpendicular to the subtalar joint axis toward the region of the posterior talo-calcanean joint, the intersection of said arch support members and said support strap being located proximate the navicular bone; and securing means for releasably attaching said free ends of said strap means to one another in rigid tension bearing engagement, said securing means including a second lacing member disposed on each free end of said strap means for cooperating with said first lacing members of said shoe upper, said securing means enabling adjustable tensioning of said support strap.

2. The sport shoe of claim 1 wherein said one piece insole sock lining is secured to the interior surface of said shoe upper.

3. The sport shoe of claim 1 wherein said metatarsal groove of said midsole is generally parabolic.

4. The sport shoe of claim 1 wherein said metatarsal gap is generally parabolic.

5. The sport shoe of claim 1 wherein said phalanges gap of said outsole extends transversely from the lateral side of said shoe proximate the distal end of the fifth phalanges bone of the wearer's foot.

6. The sport shoe of claim 1 wherein said securing means comprise a portion of a lacing system for said shoe upper.

7. The sport shoe of claim 1 wherein said upper portion of said heel counter includes a pair of forwardly extending side portions on opposite sides of said shoe tipper underlying a portion of said strap means.

8. The sport shoe of claim 1 wherein said strap means comprises a one-piece flexible support strap.

9. A sport shoe comprising:

a shoe upper for containing the wearer's foot, said shoe upper including first lacing members extending across at least a portion of said shoe upper over the instep of the wearer's foot;

said first lacing members being positioned in respective planes which are generally parallel to the longitudinal axis of the sport shoe and generally coincident with the first and third metatarsal bones of the wearer's foot when secured in the shoe;

a midsole attached to said shoe upper, said midsole having a bottom surface;

an outsole secured to the bottom surface of said midsole;

a heel counter secured to said shoe upper, said heel counter including a lower portion and an upper portion, said upper portion being positioned to extend over the lower portion of the achilles tendon of the wearer's foot; and a strap support system, said strap support system including a pair of elongated arch support members, each connected to said midsole on opposite sides of said shoe upper proximate the lesser tarsus region of the wearer's foot and extending up the sides of said shoe upper, each of said arch support members having a slot therein, said slot being disposed proximate the navicular bone;

flexible support strap means engaging said upper portion of said heel counter proximate the calcaneus bone and having a pair of free ends, said support strap means passing from said heel counter on opposite sides of said shoe upper, slideably through said slots on said arch members, and thence upwardly on opposite sides of said shoe upper proximate the middle region of the metatarsal bones of the wearer's foot;

means for limiting movement of said flexible strap means proximate the calcaneus bone to limit variations of the angle formed between said strap means and said outsole;

said arch support members and said flexible strap means being positioned to distribute forces substantially perpendicular to the axis of motion of the subtalar and midtarsal joints to maintain balance and stability of the foot in stance and during gait with the force provided by said arch support members directed generally perpendicular to the longitudinal midtarsal joint axis, the force provided by said support strap directed generally perpendicular to the subtalar joint axis toward the region of the posterior talo-calcanean joint, the intersection of said arch support members and said support strap being located proximate the navicular bone; and securing means for releasably attaching said free ends of said strap means to one another in rigid tension bearing engagement, said securing means including a second lacing member disposed on each free end of said strap means for cooperating with said first lacing members of said shoe upper, said securing means enabling adjustable tensioning of said support strap.

10. The sport shoe of claim 9 wherein said securing means comprise a portion of a lacing system for said shoe upper.

11. The sport shoe of claim 9 wherein said upper portion of said heel counter includes a pair of forwardly extending side portions on opposite sides of said shoe upper underlying a portion of said strap means.

12. The sport shoe of claim 9 wherein said strap means comprise a one piece flexible support strap.

* * * * *